US005946746A

United States Patent [19]

Bloom

[11] Patent Number: 5,946,746

[45] Date of Patent: Sep. 7, 1999

[54] QUICK INSTALL FAUCET ASSEMBLY

[75] Inventor: Mark S. Bloom, Ventura, Calif.

[73] Assignee: Emhart Inc., Newark, Del.

[21] Appl. No.: 09/133,460

[22] Filed: Aug. 13, 1998

[51] Int. Cl.[6] ..... E03C 1/04

[52] U.S. Cl. ..... 4/675; 4/676; 4/677; 4/678; 137/801

[58] Field of Search ..... 4/675, 676, 677, 4/678, 695, 696; 137/359, 606, 801; 285/64, 208

[56] References Cited

U.S. PATENT DOCUMENTS

| | | |
|---|---|---|
| 3,010,474 | 6/1961 | Moen . |
| 3,785,396 | 1/1974 | Morris et al. . |
| 3,790,966 | 2/1974 | Keane . |
| 4,005,883 | 2/1977 | Guest . |
| 4,281,857 | 8/1981 | Randall . |
| 4,553,277 | 11/1985 | Duncan . |
| 4,654,900 | 4/1987 | McGhee . |
| 4,671,316 | 6/1987 | Botnick . |
| 4,760,861 | 8/1988 | Botnick . |
| 4,762,143 | 8/1988 | Botnick . |
| 4,848,395 | 7/1989 | Krippendorf . |
| 4,852,192 | 8/1989 | Viegener . |
| 4,998,555 | 3/1991 | Barhydt, Sr. et al. . |
| 5,127,427 | 7/1992 | Kajpust et al. . |
| 5,232,008 | 8/1993 | Jeffress et al. . |
| 5,388,287 | 2/1995 | Tischler et al. . |
| 5,465,749 | 11/1995 | Sauter et al. . |
| 5,515,882 | 5/1996 | Hennis . |
| 5,584,513 | 12/1996 | Sweeny et al. . |
| B1 5,465,749 | 5/1997 | Sauter et al. . |

FOREIGN PATENT DOCUMENTS

| | | |
|---|---|---|
| 0213656 | 11/1987 | European Pat. Off. . |
| 2525296 | 10/1983 | France . |

*Primary Examiner*—Henry J. Recla
*Assistant Examiner*—Khoa D. Huynh
*Attorney, Agent, or Firm*—Harold Weinstein

[57] ABSTRACT

An apparatus is provided for installing a faucet on a top side of a deck. The apparatus includes a threaded member engaged with the faucet and extending through the mounting hole to be rotated from above the deck. A nut is threadedly connected to the threaded member to pass through the mounting hole to the underside of the deck and to be shifted toward and away from the underside of the deck responsive to the direction of rotation of the threaded member. A second member associated with and parallel to the threaded member engages the nut to prevent rotation thereof during rotation of the threaded member whereby the nut will be shifted up or down along the length of the threaded member responsive to the direction of rotation of the threaded member. A retaining bracket is pivotally connected to the nut and gravity balanced to assume a free position across the nut which is substantially perpendicular to the threaded member when the nut has been shifted downwardly sufficiently away from the deck. The retaining bracket has a greater length than a diameter of the mounting hole in the deck and is pivoted upwardly along the length of the threaded member to be carried with the nut downwardly through the mounting hole in the deck and to swing to said free position when sufficiently past the mounting hole whereby, upon rotation of the threaded member to raise the nut in the direction of the deck, the retaining bracket will engage the underside of the deck to clamp the faucet to the deck.

23 Claims, 11 Drawing Sheets

QUICK INSTALL FAUCET ASSEMBLY

BACKGROUND OF THE INVENTION

Field of the Invention

The present invention relates generally to a faucet assembly, and more particularly, to a quick install faucet assembly which can be mounted from the top of a deck to which the faucet assembly is connected.

BACKGROUND AND SUMMARY OF THE INVENTION

In conventional faucet assemblies, the mounting of the faucet assembly is completed from, or requires assembly components to be installed from the underside of the deck to which the faucet assembly is mounted. The assembly which is typically required to be performed from the underside of the deck is often awkward and uncomfortable for the installer.

It is an object of the present invention to provide a quick install faucet assembly that is mounted to the deck from above the deck, and that is simple in construction, economical to produce, and highly reliable in operation. It is another object of the present invention to provide a quick install faucet assembly that is easy to assemble or disassemble, as desired. It is still another object of the present invention to provide a quick install faucet assembly for mounting the spout and/or the end bodies of the faucet from above the deck in a quick and easy manner with a minimum of tools or operations.

Accordingly, the present invention provides a quick install faucet assembly, and more specifically, a faucet assembly that is mounted from the top of the deck to which the faucet assembly is connected.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

With reference to the accompanying drawings, the quick install faucet assembly according to the principles of the present invention will be described. The quick install faucet assembly described herein includes a spout 10 and a pair of separately mounted end body valve assemblies 12, 14. However, it should be understood that the principles of the present invention may also be applied to a faucet assembly having the spout 10 and valve assemblies 12, 14 as a single unit.

Figure 10:
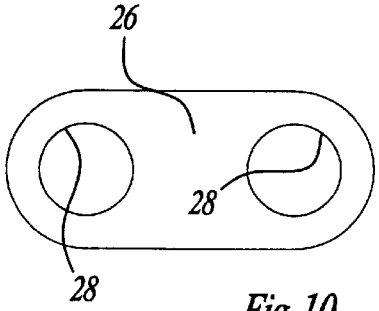
FIG. 10 is a plan view of a mounting bracket for use according to the principles of the present invention.
Figure 7:
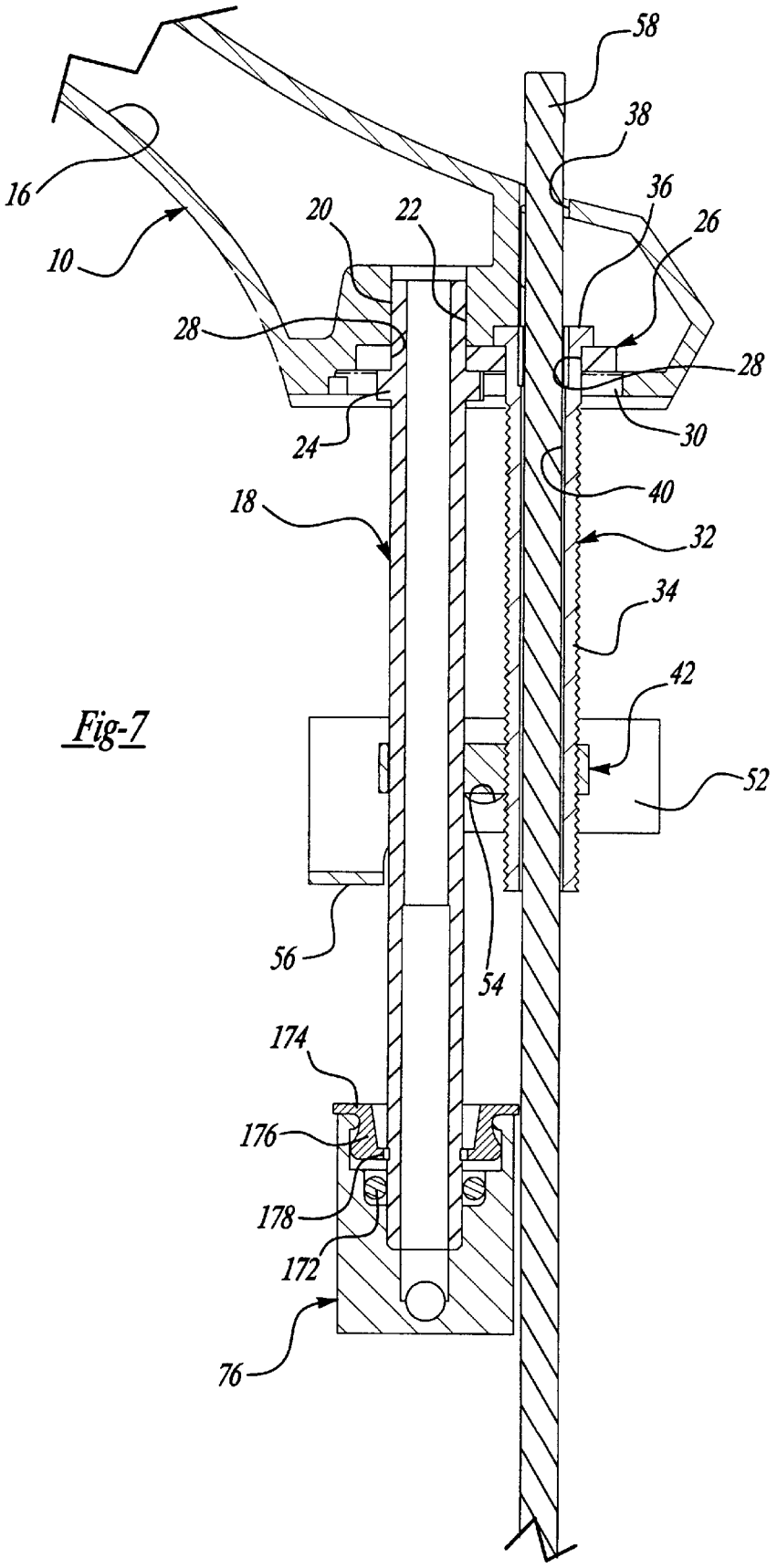
FIG. 7 is a cross-sectional view of the quick install spout assembly according to the principles of the present invention.

As shown in FIG. 7, the spout 10 includes a water passage 16 which communicates with a waterway tube 18. The waterway tube 18 has a threaded end portion 20 which engages an internally threaded portion 22 of the spout 10. The waterway tube 18 includes a radially extending hexagonal flange portion 24. A guide bracket 26 is provided with a pair of openings 28, as shown in FIG. 10, and receives the threaded portion 20 of the waterway tube 18 through one of the openings 28. The radially extending flange portion 24 supports the guide bracket 26 within a lower cavity 30 defined within the spout 10. The threaded portion 20 of waterway tube 18 is engaged with the internally threaded portion 22 of spout 10. As is known in the art, a Teflon® tape, or other seal means, can be provided on the threaded portion 20 of the waterway tube 18 in order to provide a water sealed fit.

A threaded rod 32 is provided with a hollow cylindrical body 34 which is externally threaded and is provided with an upper radially extending flange 36. The threaded rod 32 extends through the second opening 28 in guide bracket 26 while flange 36 rests against the guide bracket 26. The threaded rod 32 is aligned with an opening 38 in the spout 10 which allows access of an allen wrench for engaging an internal hexagonal engagement portion 40 provided in the upper portion of the threaded rod 32. In the completed faucet assembly, a pop-up rod 58 extends through the central opening of the threaded rod 32 and through the opening 38 in spout 10. As is well known in the art, the pop-up rod 58 engages a drain stopper assembly (not shown) for opening and closing the drain stopper.

Figure 8:
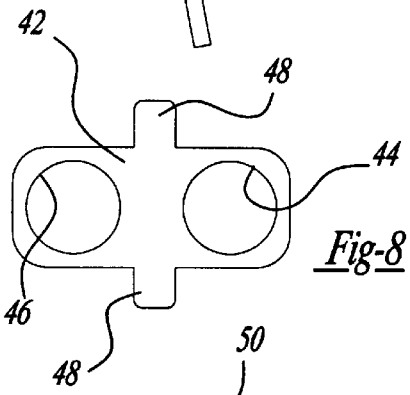
FIG. 8 is a plan view of the spout nut, according to the principles of the present invention.
Figure 9:
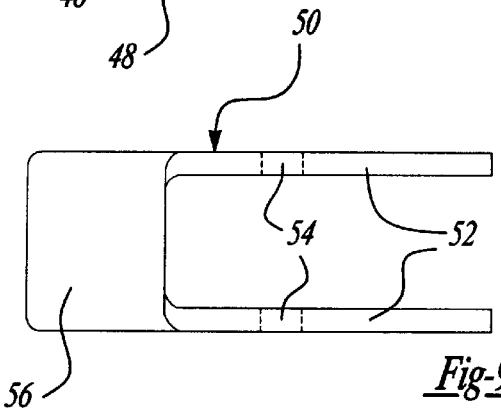
FIG. 9 is a plan view of the pivoting retainer according to the principles of the present invention.

A nut member 42 is threadedly engaged with the threaded rod 32. As best shown in FIG. 8, the nut member 42 includes a threaded opening 44 which engages the threaded rod 32 and a second opening 46 which slidably receives the waterway tube 18. The nut member 42 also includes two pivot arms 48 which extend from opposite sides of the nut member 42. A retainer member 50 is pivotally mounted to the nut member 42. The retainer member 50 includes a pair of generally parallel arms 52 having centrally located pivot openings 54. A cross bar 56 extends between the arms 52 as best shown in FIG. 9. The pivot arms 48 of nut member 42 extend through pivot openings 54 of retainer member 50 for pivotally supporting the retainer member 50 thereon. It should be noted that the nut member 42 can be modified to include a pivot pin extending therethrough for supporting the retainer member 50.

Figure 2:
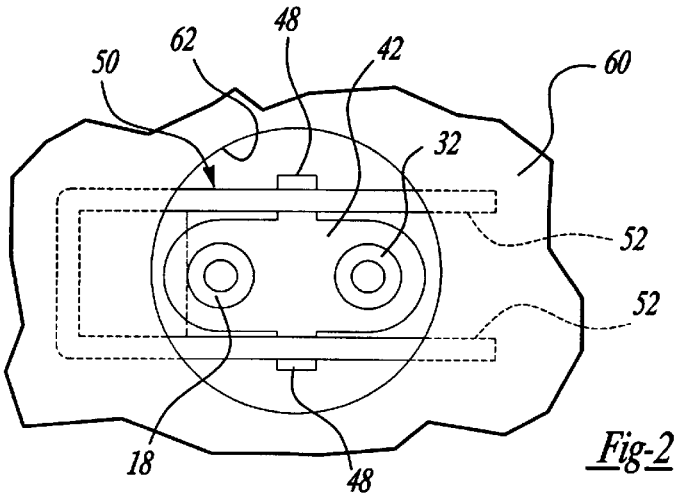
FIG. 2 is a cross-sectional view taken along line 2 of FIG. 1.
Figure 3:
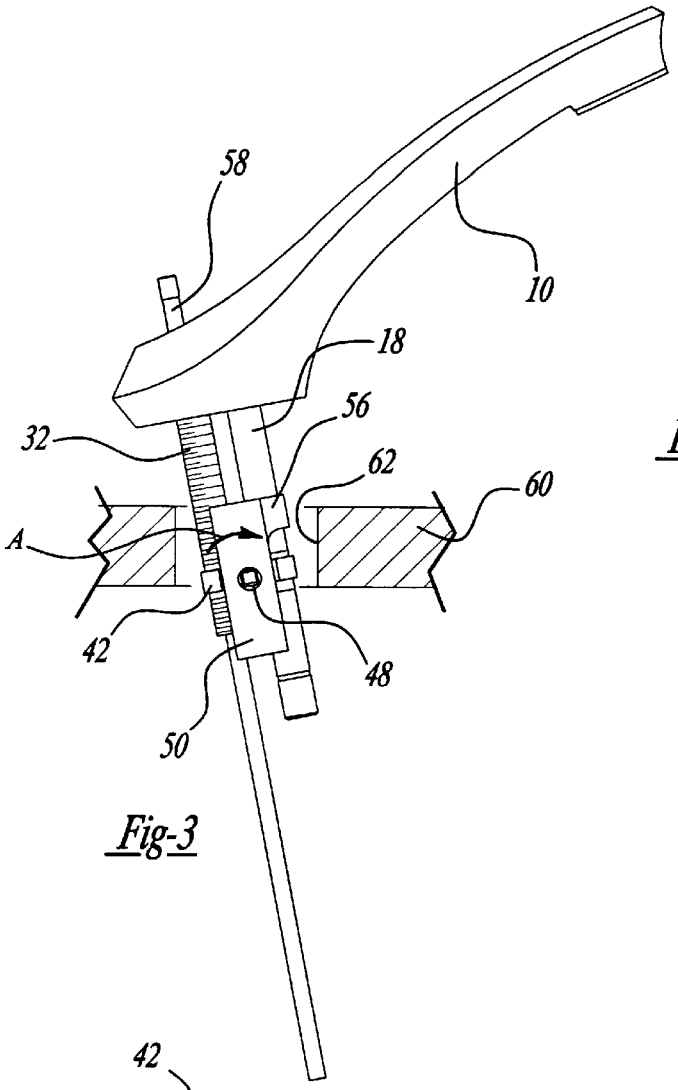
FIG. 3 is a side view illustrating the insertion of the spout through an opening in the deck according to the principles of the present invention.
Figure 4:
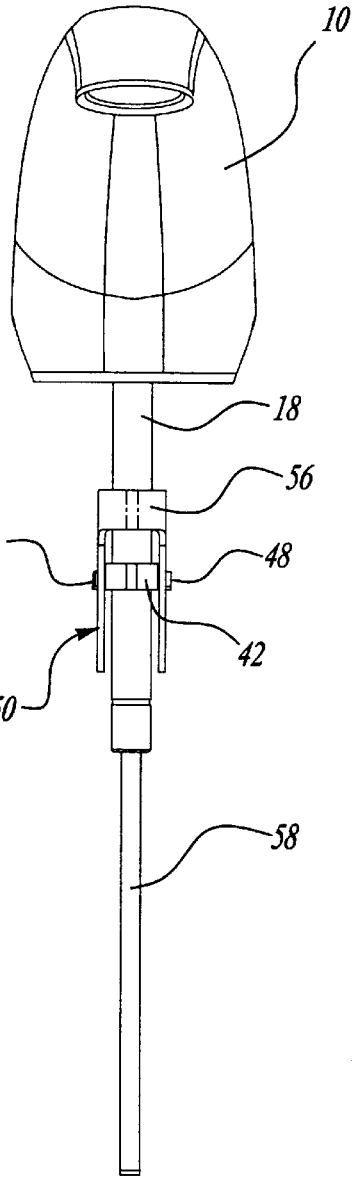
FIG. 4 is a front view of the spout assembly with the pivoting retainer in the upright position.
Figure 5:
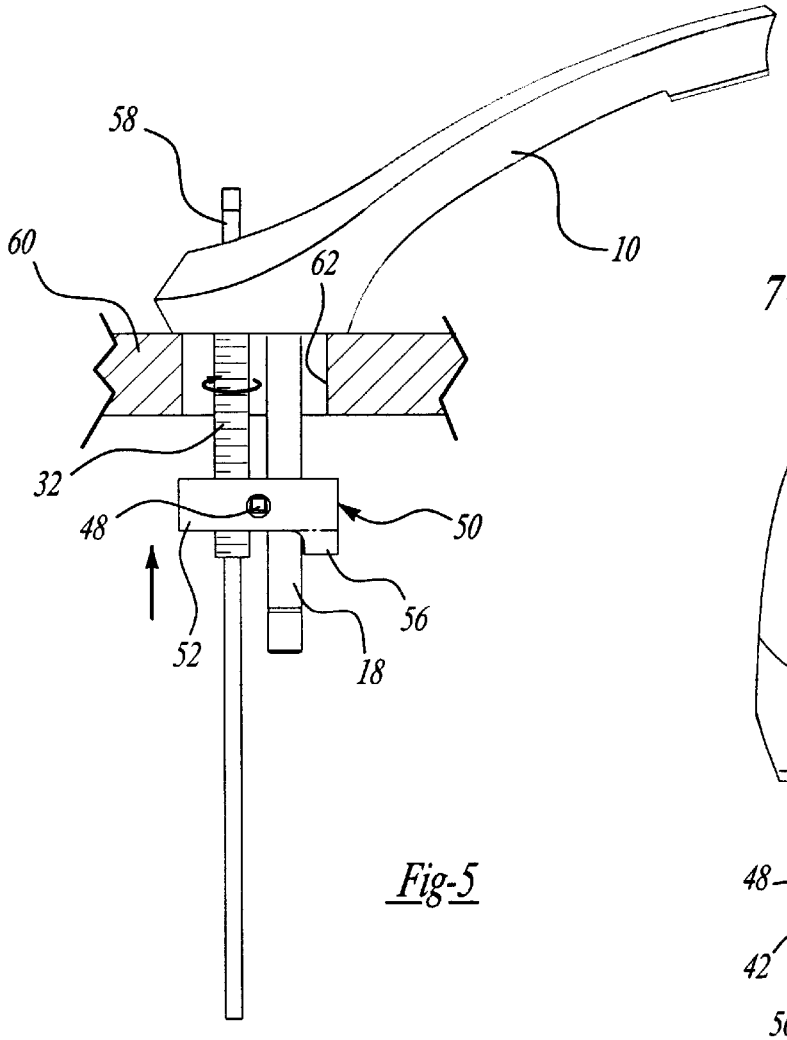
FIG. 5 is a side view of the spout assembly inserted in an opening in the deck with the pivoting retainer in the horizontal position, according to the principles of the present invention.
Figure 6:
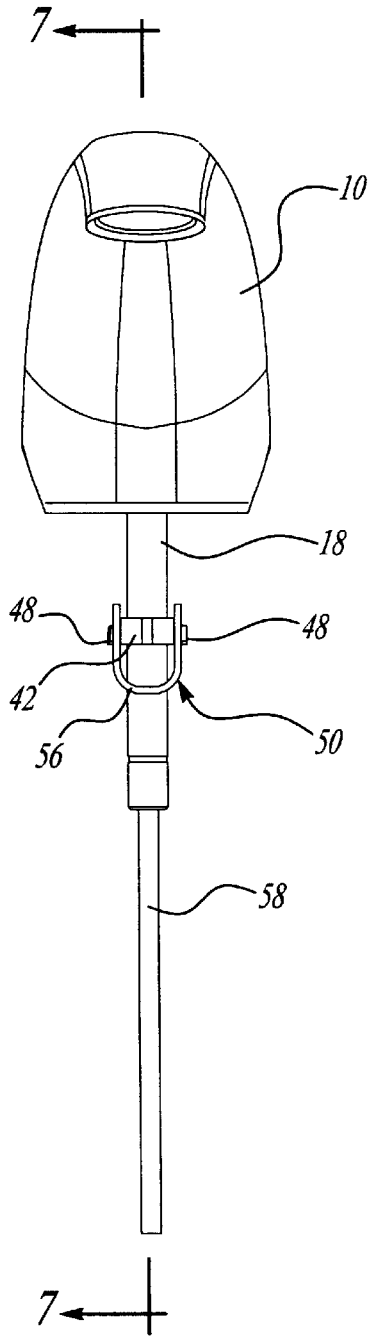
FIG. 6 is a front view of the spout assembly with the pivoting retainer in the horizontal position for engaging the deck, according to the principles of the present invention.

With reference to FIGS. 3–6, the installation of the spout according to the principles of the present invention will now be described. The spout is mounted to a deck or mounting surface 60 which is provided with an opening 62 for receiving the threaded rod 32 and waterway tube 18 of the spout assembly. As shown in FIG. 3, the retainer member 50 is pivoted to a generally vertical position extending longitudinally with the waterway tube 18 and threaded rod 32 such that the cross bar 56 rests against the waterway tube 18. The spout assembly can be optionally tilted counter clockwise, as shown in FIG. 3, so that the cross bar 56 of the retainer member 50 is stable against the waterway tube 18. Otherwise, the installer can hold the retainer member 50 in the vertical position upon insertion through the opening 62. After the retainer member 50 passes through the opening 62 in the deck 60 and the spout is rotated to the final position such that the threaded rod 32 and waterway tube 18 extend generally vertically, the weight of the cross bar portion 56 of the retainer member 50 causes the retainer member 52 to rotate in a direction of arrow A, as shown in FIG. 3, until the cross bar 56 contacts the waterway tube 18 in a generally horizontal position as shown in FIG. 5. At this point, an allen wrench can be inserted through the opening 38 in the spout 10 to engage the hexagonal portion 40 of the threaded rod 32. The threaded rod 32 can then be turned in order to draw the nut member 42 and retainer member 50 in an upward direction so that the end portions of the parallel arms 52 of the retainer member 50 engage the underside of the deck 60 at four points spaced about opening 62, as best shown in FIG. 2. The pop-rod 58 is slidably received in the opening in the threaded rod 32 and can be easily removed so that the allen wrench can be inserted through the opening 38 of spout 10 to engage the hexagonal portion 48 of the threaded rod 32.

Figure 1:
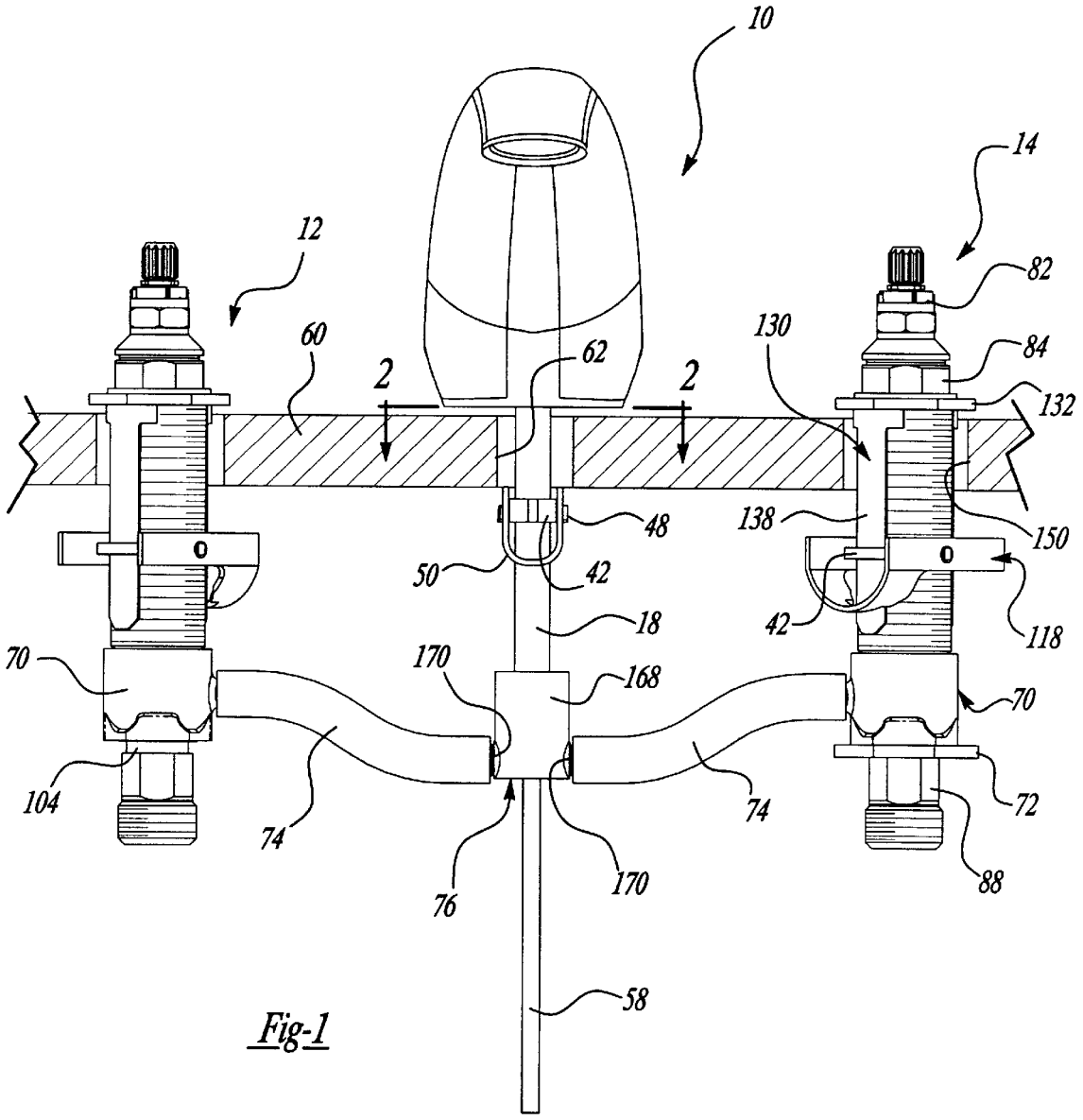
FIG. 1 is a front view of the quick install faucet assembly according to the principles of the present invention.

As shown in FIG. 1, the quick install faucet assembly of the present invention is provided with first and second end body valve assemblies 12, 14. One of the end body valve assemblies 12 is provided for the hot water line while the other of the end body valve assemblies 14 is for the cold water supply line. Each end body valve assembly 12, 14 is provided with an end connector 70, secured in place by a connector clip 72, for communicating water via interconnecting hoses 74 to the T-joint connector 76 mounted to the waterway tube 18 of spout assembly 10.

Figure 16:
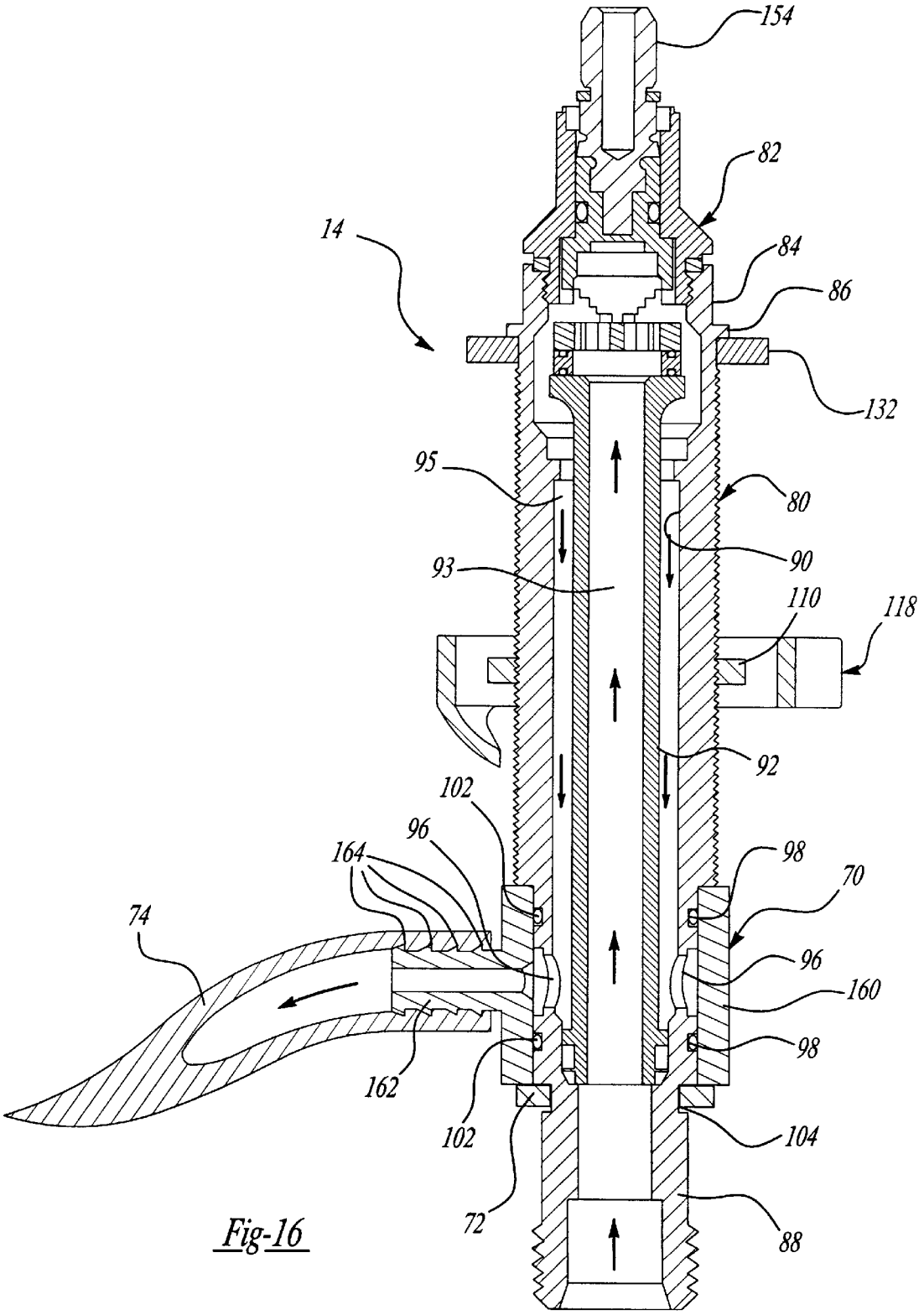
FIG. 16 is a cross-sectional view of the end body valve assembly according to the principles of the present invention.
Figure 20:
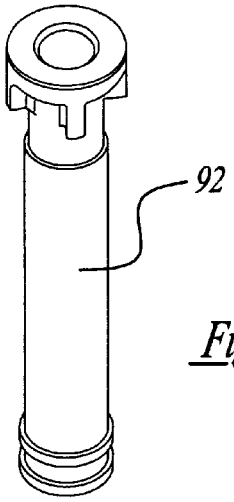
FIG. 20 is a perspective view of the spacer tube for use with the end body valve assembly according to the principles of the present invention.

With reference to FIG. 16, end body valve assembly 14 will be described. It should be understood that the end body valve assemblies 12, 14 have identical configurations and that a separate detailed description of each valve assembly is unnecessary. The end body valve assembly 14 includes a threaded body 80 mounted to a shut-off valve 82. The threaded body 80 includes an upper hexagonal head portion 84 provided with a radially extending flange 86 below the hexagonal head portion 84. The threaded body 80 also includes a hollow longitudinally extending base portion 88 which defines the waterflow path as best shown in FIG. 16. The threaded body 80 has a hollow central portion 90 which receives a spacer tube 92 (shown in FIG. 20). Spacer tube 92 has a hollow opening therethrough which defines the central flowpath 93 which communicates fluid through the shut-off-valve 82. The shut-off valve 82 communicates water from the waterflow path 93 to a concentrically formed waterflow path 95 between the threaded body 80 and spacer tube 92 to communicate water to radially extending openings 96 in the base portion 88 of the threaded body 80. The openings 96 communicate with the end connector 70 for communicating fluid through the interconnecting hose 74. The base portion 88 of threaded body 80 is provided with radial grooves 98 for supporting O-rings 102 between the base portion 88 and the end connector 70 for providing a water-tight fit between the end connector 70 and the threaded body 80. The base portion 88 of the threaded body 80 includes a recessed area between the O-rings 102 for water flow. The base portion 88 also includes a groove 104 for receiving a retaining clip 72, as shown in FIGS. 1 and 16.

Figure 17:
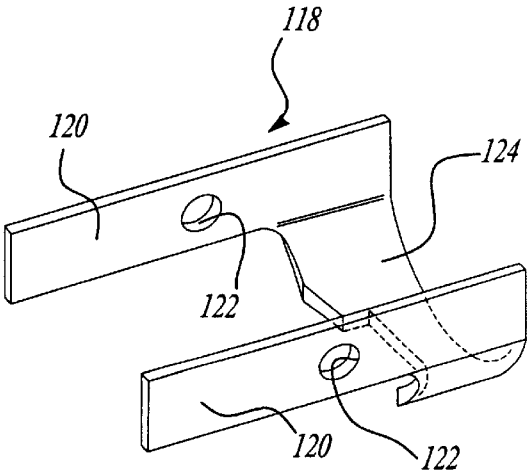
FIG. 17 is a perspective view of the pivoting retainer according to the principles of the present invention.
Figure 18:
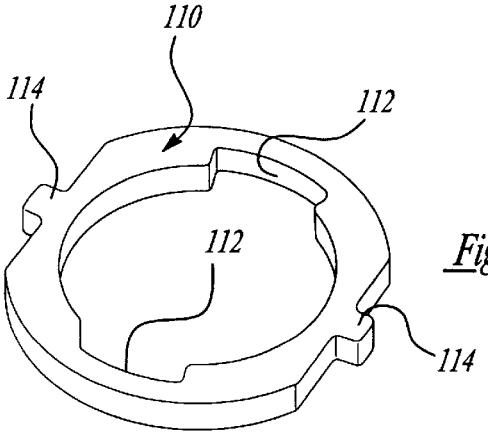
FIG. 18 is a perspective view of the threaded nut for use with the end body valve assembly according to the principles of the present invention.
Figure 19:
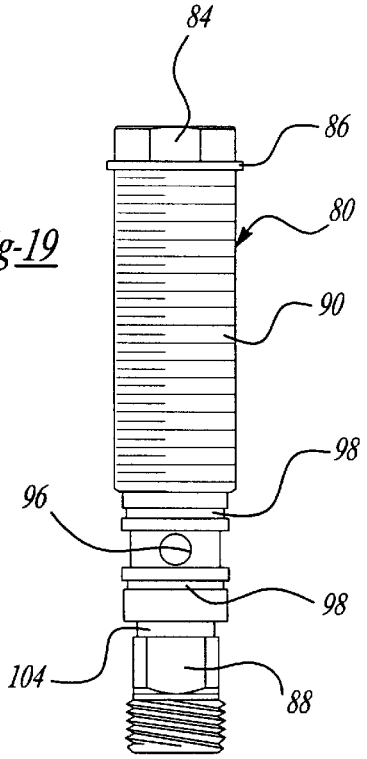
FIG. 19 is a side view of the threaded body for use with the end body valve assembly according to the principles of the present invention.

A threaded nut 110 is threadedly engaged with the threaded body 80. Threaded nut 110, as best shown in FIG. 18, is provided with a pair of oppositely disposed guide recesses 112 and a pair of oppositely disposed pivot arms 114. A pivoting retainer 118, as best shown in FIG. 17, is pivotally mounted to the threaded nut 110. The pivoting retainer 118 includes a pair of generally parallel arms 120 each provided with a pivot opening 122 for receiving the pivot arms 114 for pivotally supporting the retainer member 118 to the threaded nut 110. The retainer member 118 includes a cross bar portion 124 which extends between the arms 120.

Figure 21:
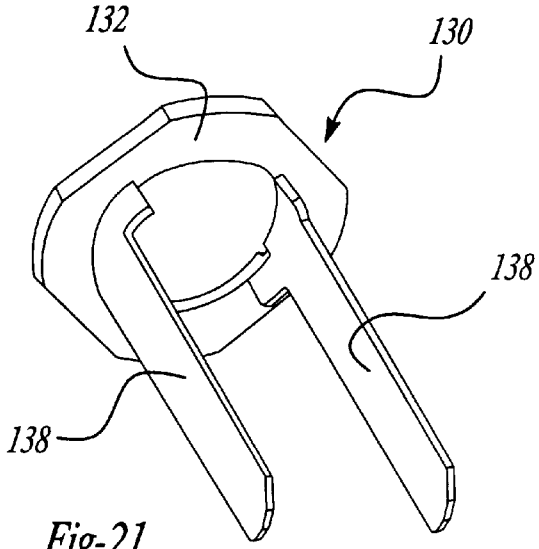
FIG. 21 is a perspective view of the nut guide assembly for use with the end body valve assembly according to the principles of the present invention.
Figure 22:
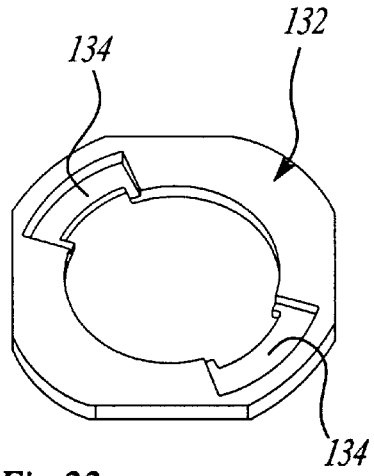
FIG. 22 is a perspective view of the guide flange of the nut guide assembly according to the principles of the present invention.
Figure 23:
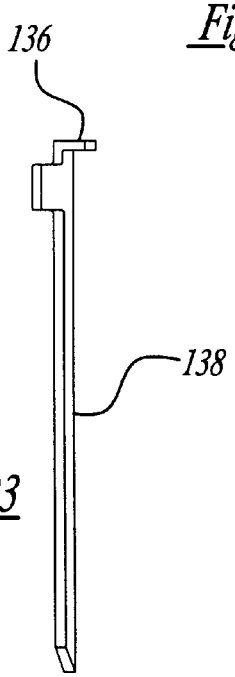
FIGS. 23 and 24 show side and front views, respectively, of the guide arm of the nut guide assembly according to the principles of the present invention.
Figure 24:
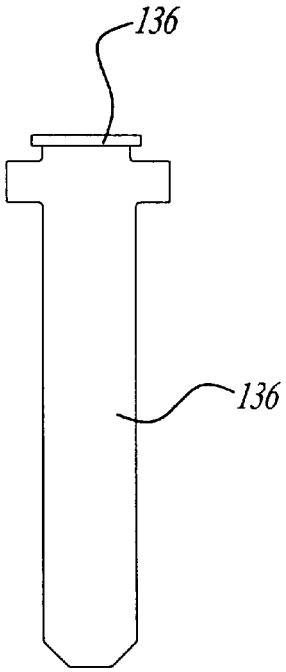
Figure 25:
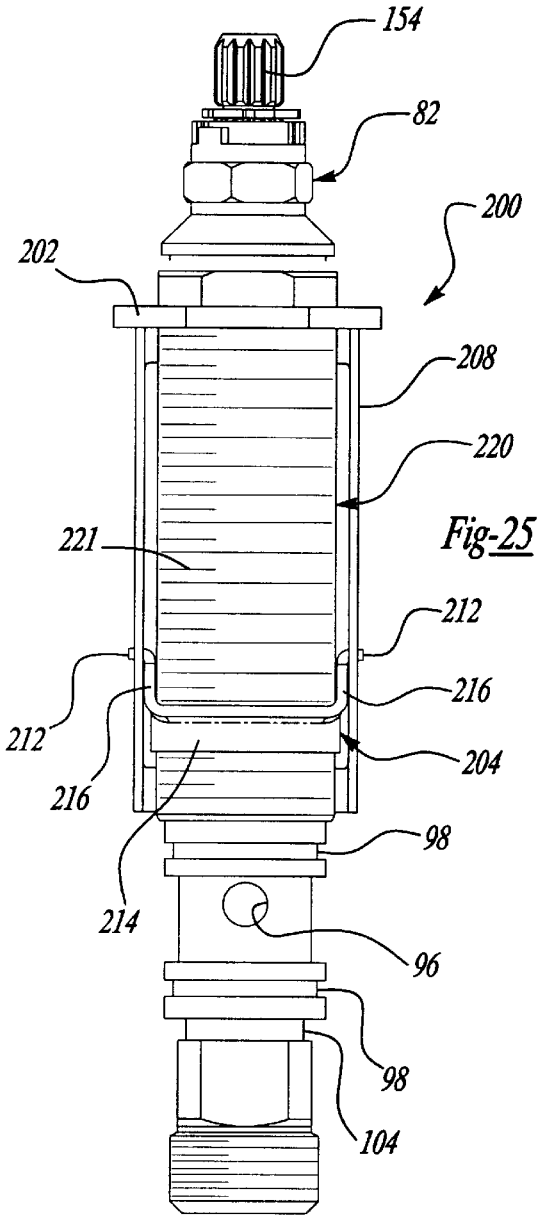
FIG. 25 is a first side view of a quick install end body valve assembly according to a second embodiment of the present invention.
Figure 26:
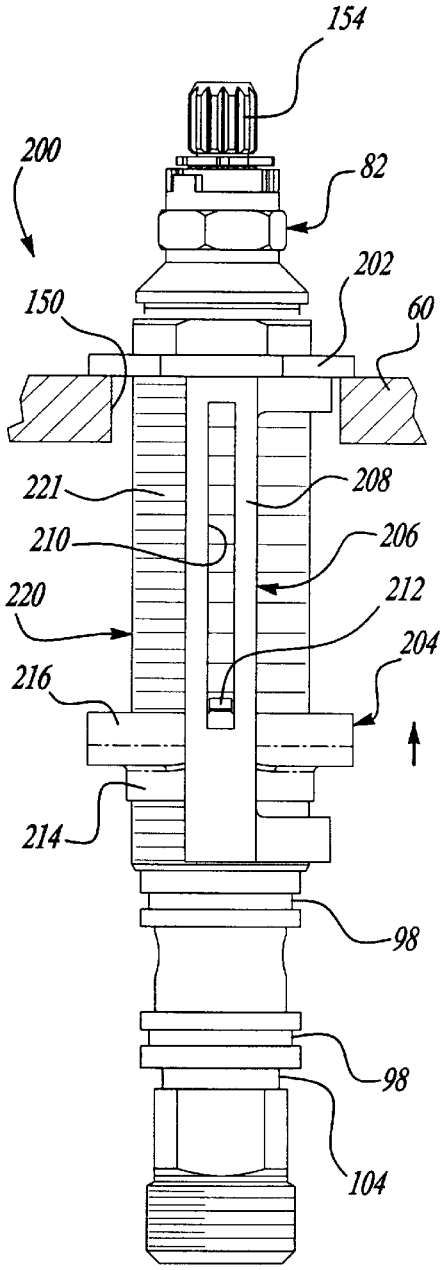
FIG. 26 is a second side view of the end body valve assembly shown in FIG. 25.

A nut guide assembly 130, as best shown in FIG. 21, is provided for guiding the threaded nut 110 and preventing rotation of the threaded nut 110. The nut guide assembly 130 includes a guide flange 132 which abuts against the radially extending flange 86 of threaded body 80. As best shown in FIG. 16, guide flange 132 includes a pair of recesses 134 which mate with an upper bend portion 136 of oppositely disposed guide arms 138, as best shown in FIGS. 23 and 24. As the guide flange 132 rests against the radially extending flange 86, the flange 86 helps to hold the upper bend portion 136 of the arms 138 in the recesses 134. The guide arms 138 extend through the guide recesses 112 in the threaded nut 110 to prevent the threaded nut 110 from rotating relative to the nut guide assembly 130. Accordingly, as the threaded body 80 is rotated, the threaded nut 110 is prevented from rotating relative to the nut guide assembly 130 therefore causing the threaded nut 110 to move upward and downward along the threaded body 80 depending upon the direction of rotation of the threaded body 80. As the threaded nut 110 moves up and down along the threaded body 80 upon rotation of the threaded body 80, the retainer member 118 moves therewith.

Figure 11:
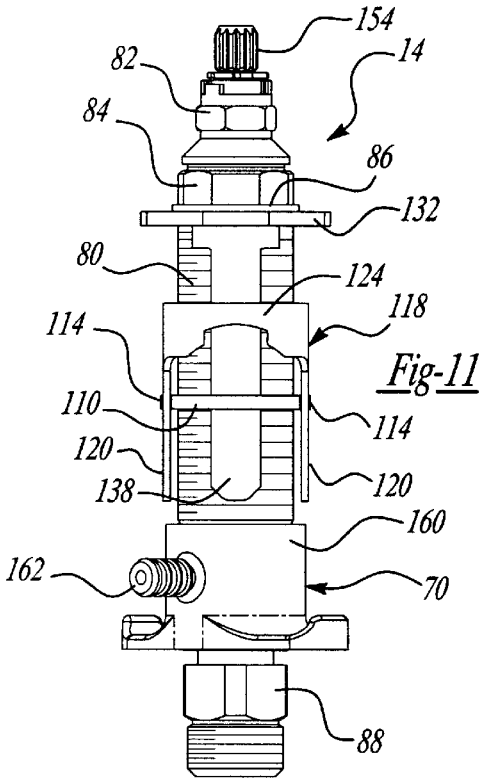
FIG. 11 is a first side view of a quick install end body valve assembly with the pivoting retainer in the upright position according to the principles of the present invention.
Figure 12:
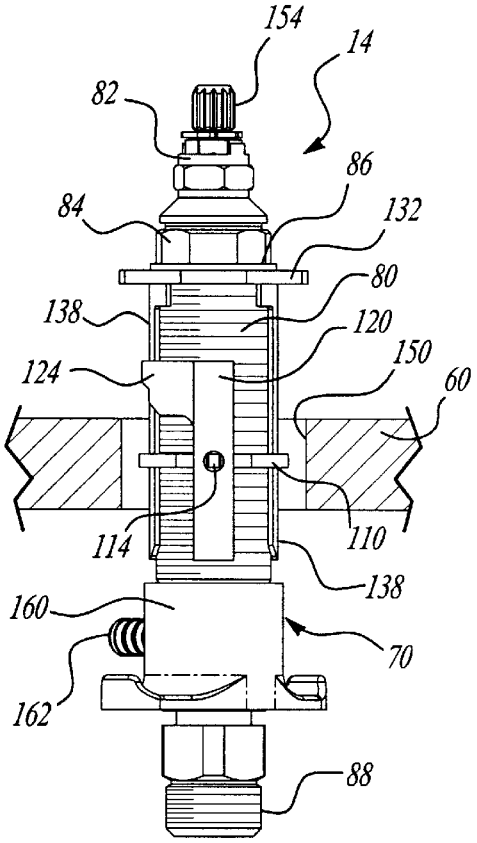
FIG. 12 is a second side view of the end body valve assembly with the pivoting retainer in the upright position according to the principles of the present invention.
Figure 13:
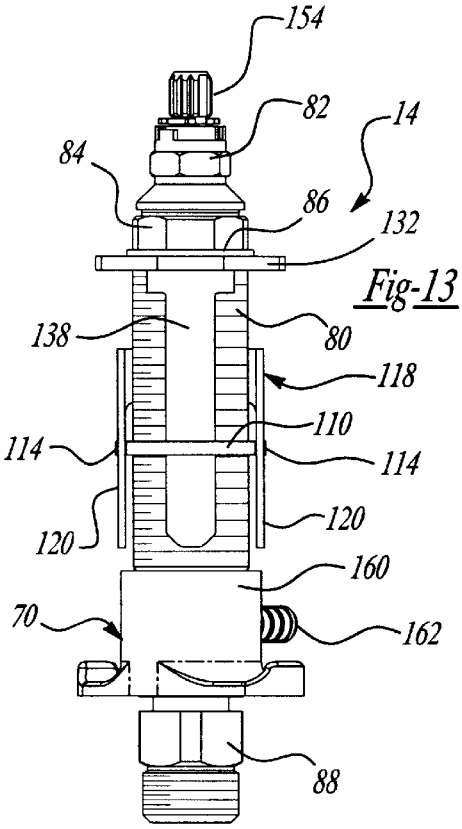
FIG. 13 is a third side view of the end body valve assembly with the pivoting retainer in the upright position according to the principles of the present invention.
Figure 14:
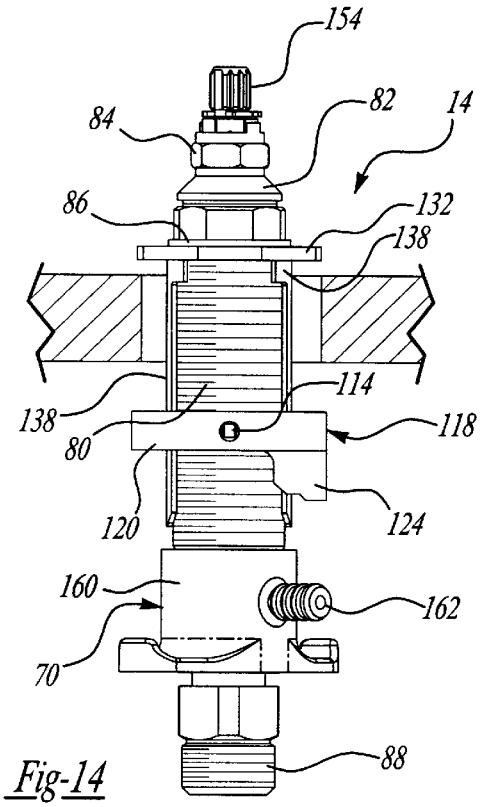
FIG. 14 is a side view of the end body valve assembly inserted in an opening in a deck and with the pivoting retainer in the horizontal position according to the principles of the present invention.
Figure 15:
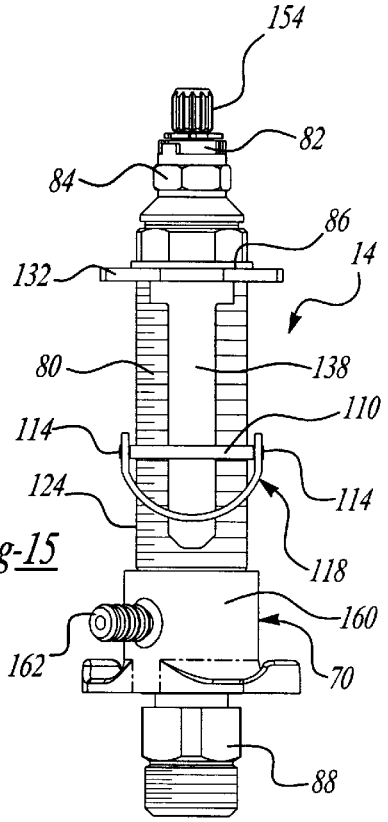
FIG. 15 is a second side view of the end body valve assembly with the pivoting retainer in the horizontal position according to the principles of the present invention.

During installation of the end body valve assembly 14, according to the principles of the present invention, the retainer member 118 is pivoted to the generally vertical position as best shown in FIG. 11–13. The end body valve assembly 14 is then inserted through an opening 150 in the deck or mounting surface 60. After insertion of the end body valve assembly 14 through the opening 150, the retainer member 118 will rotate to a horizontal position as best shown in FIGS. 14 and 15. The rotation of the retainer member 118 is due to the mass imbalance of the retainer member 118 caused by one end of the retainer member 118 being heavier than the other due to the weight of the cross bar 124.

In order to securely fasten the end body valve assembly 14 to the deck 60, the guide flange 132 is held and the threaded body 80 is rotated in a clockwise direction in order to draw the retainer member 118 upward against the underside of the deck 60. A wrench can be used to engage the hexagonal head portion 84 of the threaded body 80 in order to tighten the end body valve assembly 14 in place. The height is automatically set for proper handle height. A lever handle (not shown) would then be applied to the upper splined portion 154 of the valve 82 as is known in the art.

Figure 32:
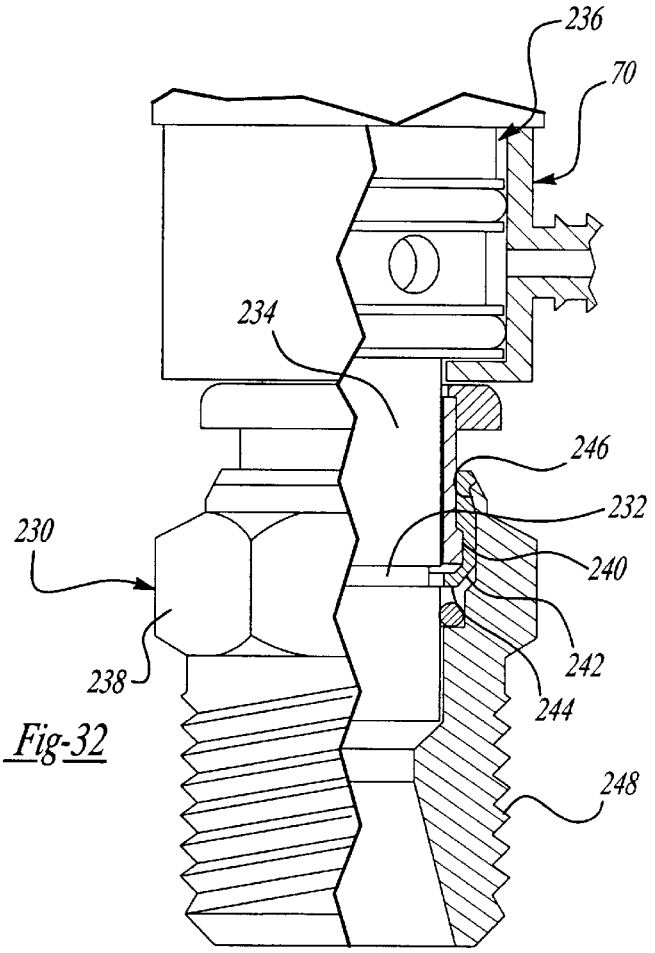
FIG. 32 is a cross-sectional view of an end body valve assembly with an alternative connector design.

At this time, the end connector 70 is attached to the end body valve assembly 14 by sliding the connector 70 over the base portion 88 of the threaded body 80 and the connector clip 72 is inserted in the groove 104 for holding the connector 70 in place. Preferably, the interconnecting hoses 74 are preassembled to the end connectors 70 and T-connector 76, thus reducing the amount of time and work done under the sink where space is limited. The end connector 70, as best shown in FIG. 16, includes a generally cylindrical body portion 160 having a radially extending port neck 162 extending therefrom. Port neck 162 includes serrations 164 on an exterior surface thereof. The serrations 164 engage with the hose 74 to secure the hose 74 to the end connector 70. As an alternative, as shown in FIG. 32, the connector 70 can be held in place by a threaded connector 230 which engages a groove 232 formed in the base portion 234 of a modified threaded body 236. The threaded connector 230 includes a main body portion 238 which receives a connector ring 240 provided with a plurality of fingers 242 with radially inwardly extending end portions 244. The interior walls 246 of the main body portion 238 are sloped so as to provide a cam for maintaining the fingers 242 engaged with the groove 232 formed in the base portion 234 of the threaded body 236. The main body portion 238 of the threaded connector 230 includes a threaded portion 248 for connecting to a water supply line (not shown). This alternative embodiment simplifies the design of the modified threaded body 236, as compared to the threaded body 80, since the threaded portion 248, for connecting to the water supply line, is formed on the threaded connector 230 instead of the base portion 88 of the threaded body 80. Preferably, the water supply line can be pre-assembled to the threaded connector 230 and the threaded connector 230 can then be simply pushed into place onto the modified threaded body 236 under the sink without the need for tools under the sink where space to work is limited. The threaded connector 230, as shown, is commercially available from the PARFLEX division of Parker Hannifin, 1300 N. Freedom Street, Ravenna, Ohio 44266.

Figure 33:
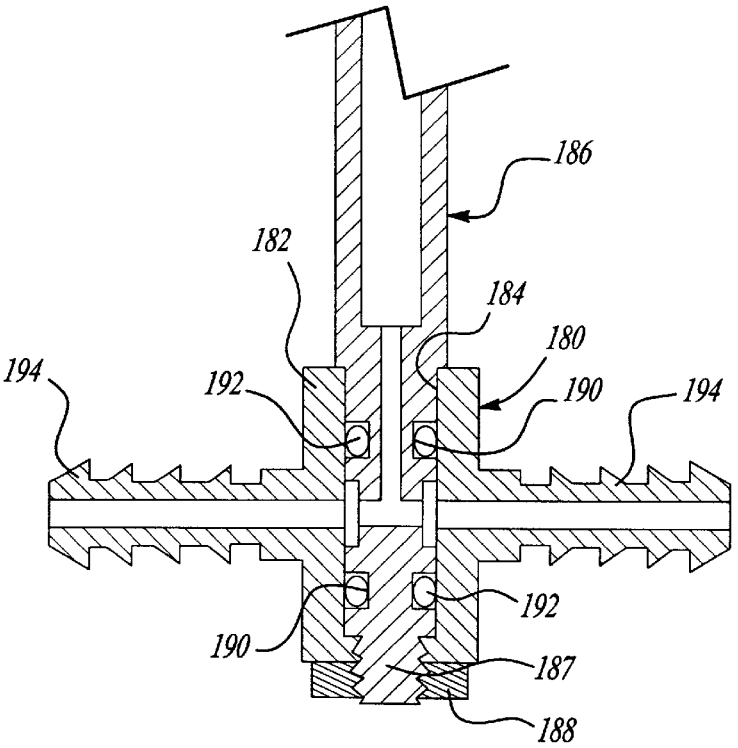
FIG. 33 is a cross-sectional view of an alternative T-connector design for use with the present invention.

The T-connector 76, shown in FIG. 1, includes a body portion 168, as best shown in FIG. 7, connected to the waterway tube 18 and further having first and second hose connector portions 170 for connecting with the hoses 74. The body portion 168, as shown in FIG. 7, supports an O-ring 172 which surrounds the waterway tube 18 as well as a connector ring 174. The connector ring 174 includes a plurality of fingers 176 which extend longitudinally and are provided with radially inwardly extending end portions 178. The radially inwardly extending end portions 178 engage an annular groove 180 formed in the exterior surface of the waterway tube 18 in order to secure the T-connector 76, as best shown in FIG. 1, to the waterway tube 18. The T-connector 76 is commercially available from the PARFLEX Division of Parker Hannifin, 1300 N. Freedom Street, Ravenna, Ohio 44266. As an alternative, a modified T-connector 180, as shown in FIG. 33, can be utilized. The T-connector 180 includes a body portion 182 including a cylindrical bore 184 for receiving the end of the waterway tube 186. The waterway tube 186 includes a threaded end portion 187 for mating with a threaded nut 188 for securing the T-connector 180 in place. The waterway tube 186 has a pair of grooves 190 which each receive an O-ring 192 for providing a watertight sealed relationship between said waterway tube 186 and the T-connector 180. The T-connector 180 includes a pair of serrated hose connector portions 194.

Figure 27:
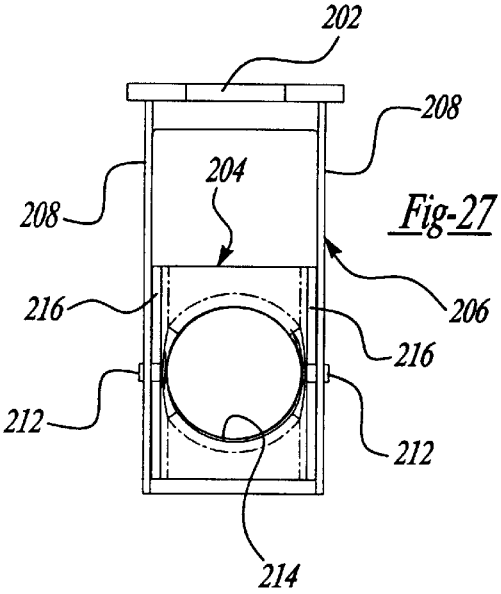
FIG. 27 is a first side view of a bracket and nut assembly according to the second embodiment of the present invention.
Figure 28:
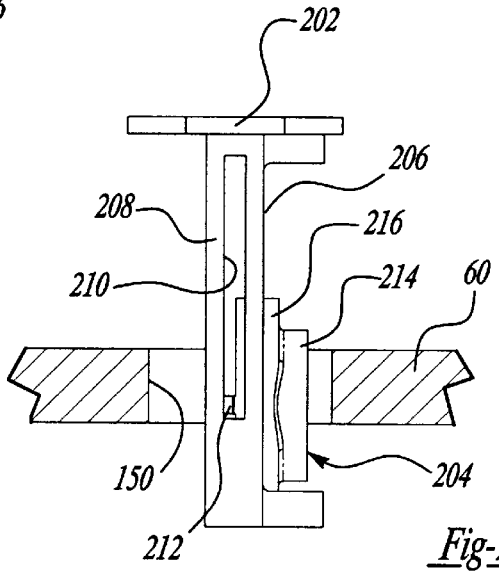
FIG. 28 illustrates a second side view of the bracket and nut assembly shown in FIG. 27 with the bracket and nut assembly being inserted through an opening in a deck.
Figure 30:
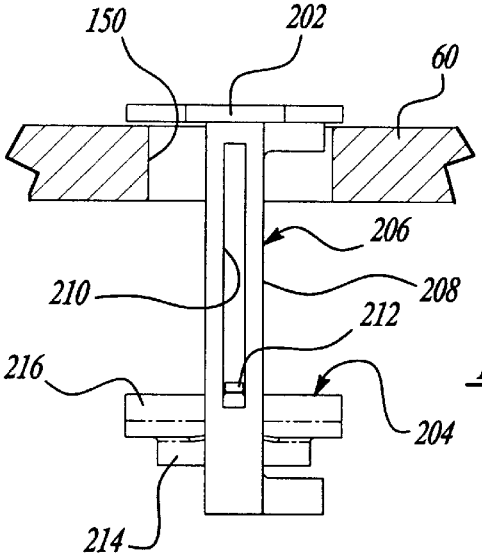
FIG. 30 is a second side view of the bracket and nut assembly shown in FIG. 29 inserted in an opening in a deck with the retainer in the horizontal position.
Figure 29:
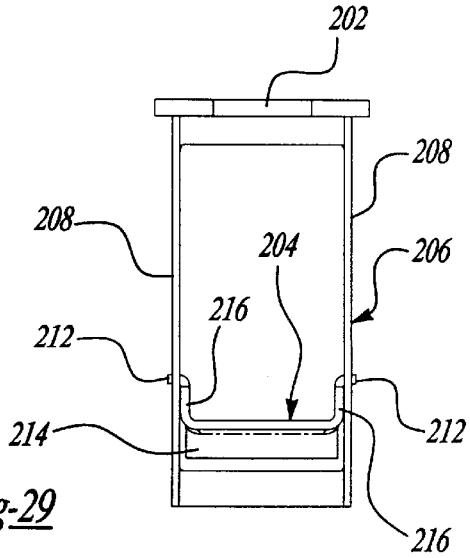
FIG. 29 is a first side view of the bracket and nut assembly shown in FIG. 27 with the retainer in the horizontal position.
Figure 31:
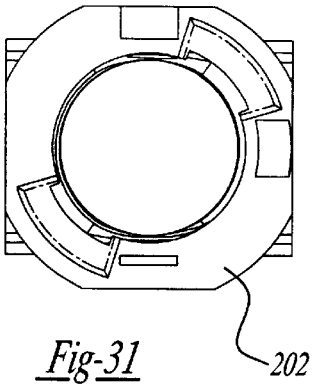
FIG. 31 is a top view of the bracket and nut assembly shown in FIG. 30.

With reference to FIGS. 25–30, a second embodiment of the end body valve assembly 200 will be described. The end body valve assembly 200 is attached to a sink or deck by an upper bracket 202 and a lower nut retainer 204, best shown in FIGS. 27–30. The upper bracket 202 is not threaded and is attached to a bracket 206. The bracket 206 includes a pair of long arms 208 with elongated slots 210. The lower nut retainer 204 has a pair of pivot arms 212 which extend laterally outward and includes a threaded body portion 214 and a pair of spaced retaining wall portions 216. The pivot arms 212 are slidably received in the elongated slots 210 of arms 208 such that the lower nut retainer 204 swivels between the two slots 210. During installation of the valve body assembly 200 the lower nut retainer 204 swings upward in a vertical position as shown in FIGS. 27 and 28 so that the lower nut retainer 204 and bracket 206 can be inserted through the opening 150 in the deck 60. The lower nut retainer 204 swings downward to a generally horizontal position due to gravity once the nut retainer 204 has passed through the opening 150. The retaining wall portions 216 of the lower nut retainer 204, in the horizontal orientation, extend over the edges of the opening 150.

An end body 220 is then inserted through a center of the upper bracket 202 and lowered to the lower nut retainer 204. The end body 220 includes a threaded outer surface 221 such that upon rotation of the end body 220, the end body 220 engages the lower nut retainer 204. To tighten the end body 220 to the deck, the upper bracket 202 can be held in place while the threaded valve body 220 is rotated. The valve body rotation causes the lower nut retainer 204 to move up the threaded valve body 220 until the deck 60 is sandwiched by the upper bracket 202 and lower nut retainer 204. In this embodiment, the end body 220 supports a valve 82 and an internal spacer tube 92 in the same manner as shown in FIG. 16.

The quick connect faucet assembly, according to the principles of the present invention, provides an installation which is much faster than conventional faucets. Furthermore, installation is simplified since all components are tightened from above the sink.

The quick install faucet assembly of the present invention has no loose parts that can be misplaced. The end body and spout can be preassembled and ready for installation by the user. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for installing a fixture on a top side of a deck having at least one mounting hole therein, comprising:

a threaded member adapted to be engaged with the fixture and extend through the mounting hole to be rotated from above the deck;

a nut threadedly connected to the threaded member to pass through the mounting hole to the underside of the deck and to be shifted toward and away from the underside of the deck responsive to the direction of rotation of the threaded member;

a second member associated with and parallel to the threaded member, the second member engaging the nut to prevent rotation thereof during rotation of the threaded member whereby the nut will be shifted up or down along the length of the threaded member responsive to the direction of rotation of the threaded member said threaded member and said second member having longitudinal axis lying in a first plane;

a retaining bracket having at least one leg having a longitudinal axis pivoting in a second plane parallel to said first plane and pivotally connected to the nut and gravity balanced to assume a free position across the nut which is substantially perpendicular to the threaded member when the nut has been shifted downwardly sufficiently away from the deck, said retaining bracket having a greater length than a diameter of the mounting hole in the deck and being pivoted upwardly along the length of the threaded member to be carried with the nut downwardly through the mounting hole in the deck and to swing to said free position when sufficiently past the mounting hole whereby, upon rotation of the threaded member to raise the nut in the direction of the deck, the retaining bracket will engage the underside of the deck to clamp the fixture to the deck.

2. The apparatus according to claim 1, wherein:

the retaining bracket includes said at least one leg and a cross bar formed at one end thereof to extend substantially at a right angle thereto;

a pin pivotally connecting a middle of the at least one leg of the retaining bracket to the nut; and the cross bar to limit movement of the at least one leg and to permit passage of the retaining member through the mounting hole.

3. The apparatus according to claim 2, wherein the at least one leg having the end thereof with the cross bar is pivoted upwardly and engagable with the threaded member to permit passage of the retaining member through the mounting hole.

4. The apparatus according to claim 2, wherein the cross bar limits the raising and the lowering of the at least one leg to prevent excess pivotal movement of the at least one leg in either direction.

5. The apparatus according to claim 1, wherein the retaining bracket is formed in a substantial "U" shape with a pair of legs extending on opposite sides of the nut and a cross bar connected across one end of the legs such that said cross bar limits movement of said retaining bracket and permits passage of the retaining member through the mounting hole.

6. The apparatus according to claim 5, wherein the retaining bracket is pivoted upwardly to define an inverted "U" shape for passage through the mounting hole.

7. The apparatus according to claim 1, wherein the second member is spaced from the threaded member;

the nut includes a threaded hole in engagement with the threaded member and slidingly engaging the second member; and a pin for pivotally connecting the retaining bracket to the nut to permit the retaining bracket to shift freely between a substantially vertical and a substantially horizontal position.

8. The apparatus according to claim 7, wherein the nut includes a second hole for slidingly engaging the second member to prevent rotation of the nut during rotation of the threaded member whereby the nut will be moved in the direction of, toward or away from, the underside of the deck thereby.

9. The apparatus according to claim 8, wherein the threaded member is hollow with an opening extending therethrough; and a drain lift line extending through the opening in the threaded member.

10. The apparatus according to claim 8, wherein the second member defines a waterway to the fixture.

11. The apparatus according to claim 1, wherein:

the fixture defines a spout;

the second member threadedly engages the spout;

a connecting plate is provided including a pair of holes; one through which the second member passes and the other through which the threaded member passes;

the connecting plate non-movably clamped to the spout by the second member;

the threaded member having an enlarged head which sits atop the plate and which is turnable therein to raise or lower the nut thereon.

12. The apparatus according to claim 1, wherein:

the fixture defines an end body having a valve therein;

the retaining bracket is formed in a substantial "U" shape with a pair of legs extending on opposite sides of the nut and a cross bar connected across one end of the legs;

pivot means connect the retaining bracket to the nut; and the retaining bracket is pivoted upwardly with the cross bar to limit the movement thereof and permit passage of the retaining member through the mounting hole.

13. The apparatus according to claim 12, wherein:

the retaining bracket is pivoted upwardly to define an inverted "U" shape for passage through the mounting hole.

14. The apparatus according to claim 13, wherein:

the second member has a top disc journaled to the threaded member;

a pair of guide arms connected to the top disc extend parallel to the threaded member on opposite sides thereof; and the nut has a pair of recesses through which the guide arms extend to prevent the nut from rotating during rotation of the threaded member whereby the nut will be caused to be shifted toward or away from the deck upon rotation of the threaded member.

15. A faucet, comprising:

a spout having a passage therein;

a tube connected to said spout for delivering water to said passage;

a threaded rod rotatably connected to said spout;

a nut member having a threaded opening for engaging said threaded rod; and a retainer member pivotally mounted to said nut member, said retainer member including a pair of arms disposed on opposite sides of said nut member and a cross bar extending between one end of said pair of arms, wherein upon rotation of said threaded rod, said nut member and retainer member move relative to said spout, said pair of arms of said retainer member engaging an underside of a mounting surface for securely mounting said spout to said mounting surface.

16. The faucet according to claim 15, wherein said spout includes an opening in a top portion thereof for accessing a tool engaging portion of said threaded rod.

17. The faucet according to claim 16, wherein said opening in said top portion of said spout is provided for receiving a pop-up rod for engaging a drain stopper device.

18. The faucet according to claim 15, wherein said retainer member is pivotable between a first generally vertical position and a second generally horizontal position such that said cross bar of said retainer member rests against said waterway tube in both said first generally vertical position and said second generally horizontal position.

19. The faucet according to claim 15, further comprising a pair of end body valve assemblies each including:

a threaded body rotatably mounted to a shut-off valve;

a nut member threadedly engaging said threaded body; and a retainer member pivotally mounted to said nut member and including at least one arm, wherein upon rotation of said threaded body said nut member and said retainer member move relative to said threaded body, said at least one arm of said retainer member engaging an underside of a mounting surface for securely mounting said end body valve assemblies to said mounting surface.

20. An end body valve assembly for use with a faucet, comprising:

a valve assembly;

a threaded body rotatably mounted to said valve assembly;

a nut member threadedly engaging said threaded body; and a retainer member pivotally mounted to said nut member and including a pair of arms disposed on the opposite sides of said nut member and a cross bar extending between one end of said pair of arms, wherein upon rotation of said threaded body, said nut member and said retainer member move relative to said threaded body, said pair of arms of said retainer member engaging an underside of a mounting surface for securely mounting said end body valve assembly to said mounting surface.

21. The end body valve assembly according to claim 20, further comprising a nut guide for preventing said nut member from rotating with said threaded body.

22. An apparatus for installing a fixture on a top side of a deck having at least one mounting hole therein, comprising:

a bracket member having a first portion adapted to extend through the mounting hole and a second portion adapted to rest on the top side of said deck, said first portion including a pair of parallel arms each provided with an elongated slot;

a nut retainer including a threaded body portion with at least one retainer portion extending from said threaded body portion and a pair of pivot arms extending from opposite sides of said nut retainer and engaging said elongated slots in said pair of parallel arms of said first portion of said bracket member such that said nut retainer is pivotal relative to said bracket member, said retainer portion having a length greater than a diameter of the mounting hole and said nut retainer being pivotable to a generally vertical position to be carried with said first portion of said bracket member through said mounting hole and to swing to a free position when sufficiently past the mounting hole; and a threaded member engaged with the fixture and extendable through said second portion of said bracket member and engagable with said threaded body portion of said nut retainer whereby, upon rotation of the threaded member, the nut retainer rises in the direction of the deck such that the nut retainer will engage the underside of the deck to clamp the fixture to the deck.

23. The apparatus according to claim 22, wherein said retainer portion of said nut retainer includes a pair of retainer arms extending on opposite sides of said threaded body portion.

* * * * *